US006427018B1

(12) United States Patent
Keliiliki

(10) Patent No.: US 6,427,018 B1
(45) **Date of Patent: *Jul. 30, 2002**

(54) ADJUSTABLE EARPHONES FOR PERSONAL AUDIO AND COMMUNICATION SYSTEMS

(75) Inventor: Shawn P. Keliiliki, Orem, UT (US)

(73) Assignee: Cotron Corporation, Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/896,470

(22) Filed: Jul. 18, 1997

(51) Int. Cl.[7] ..... H04R 25/00
(52) U.S. Cl. ..... 381/381; 381/370; 381/374
(58) Field of Search ..... 381/25, 183, 187, 381/68.5, 309, 370, 371, 374, 375, 376, 380; 181/129; 351/123; 455/344, 350, 351

(56) References Cited

U.S. PATENT DOCUMENTS 466,725 A * 1/1892 Miltimore ..... 381/381
4,020,297 A * 4/1977 Brodie ..... 379/430
4,420,657 A * 12/1983 Larkin ..... 379/430
4,584,718 A * 4/1986 Fuller ..... 381/380
5,319,163 A * 6/1994 Scott ..... 381/380
5,335,285 A * 8/1994 Gluz ..... 381/183
5,367,345 A * 11/1994 Silva ..... 455/350
5,608,808 A * 3/1997 Silva ..... 381/183
5,729,615 A * 3/1998 Yang ..... 381/370

* cited by examiner

*Primary Examiner*—Huyen Le

(57) ABSTRACT

An ear mounted earphone includes a speaker housing for positioning a speaker at the entrance to the auditory canal of an ear of a user. An elongate boom extends from the speaker housing and through a sleeve at one end of an earpiece so that the boom may be moved longitudinally and rotationally within the sleeve for adjustment purposes and will be frictionally held in adjusted position by the sleeve during use. A microphone arm with microphone may be rotatably mounted on the speaker housing to provide a microphone when the earphones are used with a communication system. The rotatability of the microphone arm allowing the same earphone and microphone arm to be adjusted for use with either the right or left ear of a user. An earpiece may be conveniently integrally molded as a single piece with a slit formed therein intermediate its length so the wire to the speaker and microphone can be positioned within the earpiece. The speaker may be waterproofed by a thin waterproof material such as mylar.

13 Claims, 6 Drawing Sheets

ADJUSTABLE EARPHONES FOR PERSONAL AUDIO AND COMMUNICATION SYSTEMS

BACKGROUND OF THE INVENTION

Field

Figure 1:
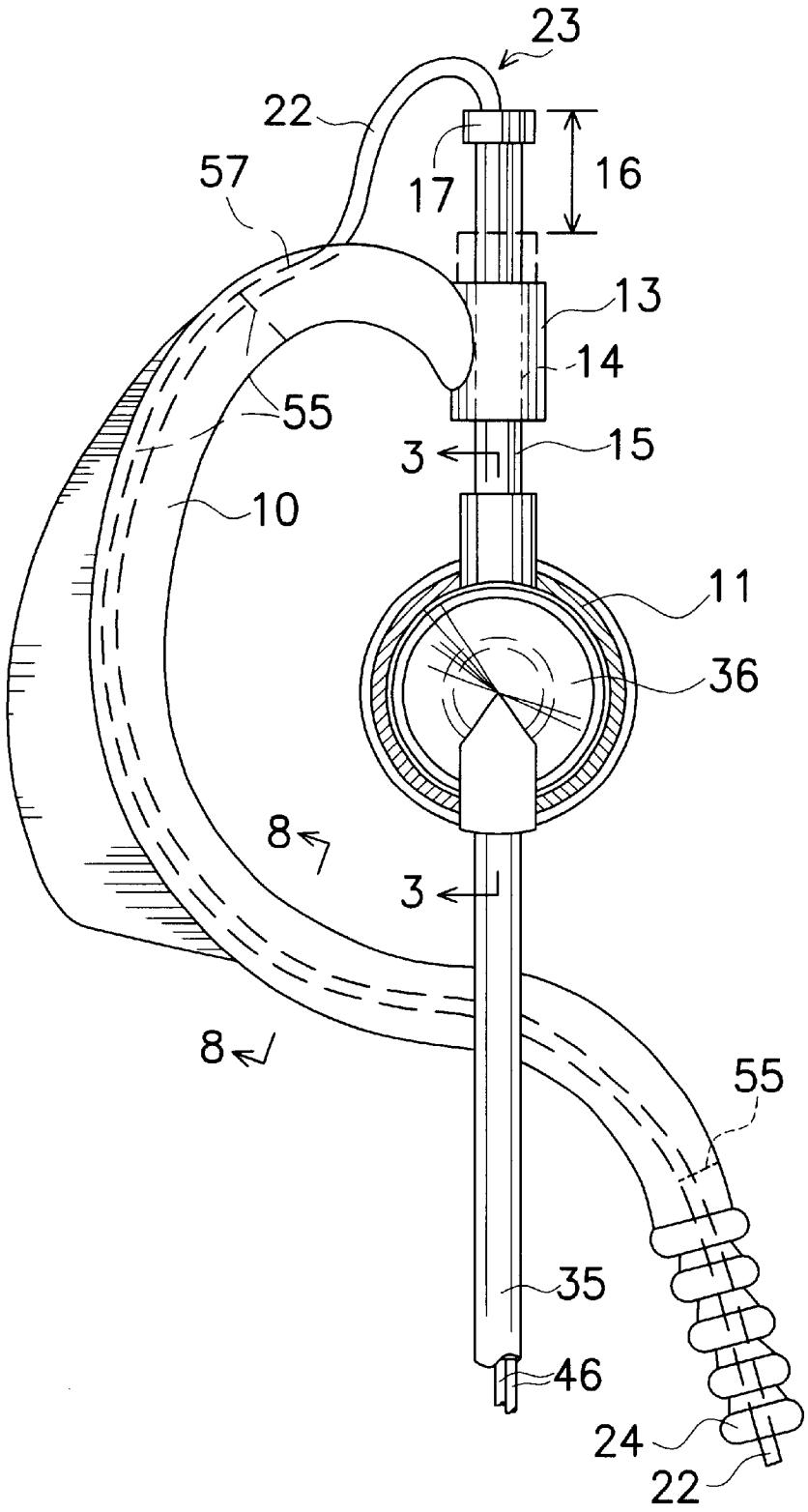

The invention is in the field of earphones for use with personal audio systems and communication systems.

State of the Art

Personal audio systems enabling a user to listen to the radio, cassette tapes, or compact disks while involved in other activities are very popular. Such systems include headphones or earphones which a user wears over or in his or her ears so that the sound from the system is heard only by the user and does not disturb others. The earphones also usually provide better sound transmission to the listener so the listener can hear and understand the sounds better than if merely transmitted into the air, particularly during movement of the user such as in sport or exercise activities or in noisy environments. Such earphones are also sometimes used in communication systems such as telephone and radio communication systems. For use with such communication systems, the earphones will often have a microphone associated therewith extending toward the user's mouth so the user can easily participate in hands-off two-way communication.

With all systems using earphones, comfort and convenience of the earphones is important. My U.S. Pat. No. 5,412,736 shows earphones designed for comfortable securement to the ear of a user and particularly for secure carriage on the ear of a user during vigorous activity by the user. While the earphones shown in U.S. Pat. No. 5,412,736 work satisfactorily to hold the earphones on a user's ear even during vigorous activity by the user and are generally comfortable, such earphones are not as adjustable as desired for some users and are not designed for use with communication systems in that they are not adapted for carrying a microphone.

SUMMERY OF THE INVENTION

According to the invention, the speaker and speaker housing of an earphone is mounted to an ear mounting means for both rotational and spatial adjustment with respect to the ear mounting means so that a user can adjust the positioning of the speaker housing for maximum comfort. A microphone arm may be mounted to one of the housings so that earphones may be used in communication systems requiring a microphone and in a preferred embodiment, the microphone arm is mounted for approximately 270 degrees of rotation with respect to the housing so that the earphone with microphone arm can be worn on either the left or the right ear and the microphone arm will extend to the area of a user's mouth.

The invention provides an elongate boom extending from the speaker housing through a sleeve in the ear mounting means. The boom is frictionally held in the sleeve and can be rotated in the sleeve and slid longitudinally in the sleeve to adjust the orientation and positioning of the speaker with respect to the ear mounting means. In this way, the earphone can be adjusted for a comfortable fit by substantially all users.

While with personal audio systems two earphones, one for each ear, will be provided and used, with communication systems, either a single earphone or two earphones may be used. Where easy two way communication is desired, the single earphone, or one of the two earphones used, will be provided with a microphone arm extending from the speaker housing to hold and position a microphone in operable location near the mouth of a user to enable the microphone to pick up sound emanating from the user's mouth. It is preferred that the microphone arm be mounted to the speaker housing for about 270 degrees of rotation with respect to the housing so the arm may be rotated and the earphone used on either the right ear or left ear as preferred by the user. The microphone and its mounting may be removable so the earphones may be used either with or without a microphone.

A waterproof or water resistant cover may be installed in the speaker housing over the speaker cover to make the earphone water resistant to prevent rusting or other corrosion of metal parts of the speaker and other possible damage to the speaker from perspiration or other moisture that the earphones may encounter during use or storage.

The earphones of my cited patent required manufacture of the earpiece by molding two earpiece halves, inserting the wire from the speaker in one half and gluing the halves together. According to the present invention, the earpiece is molded as a single piece with a slit extending into the earpiece along the intermediate portion of the length of the earpiece. The wire can then be inserted through the ends of the earpiece into the ends of the slit with, for example, a needle and positioned within the slit between the ends of the earpiece to enclose the wire in the earpiece.

DRAWINGS

Figure 2:
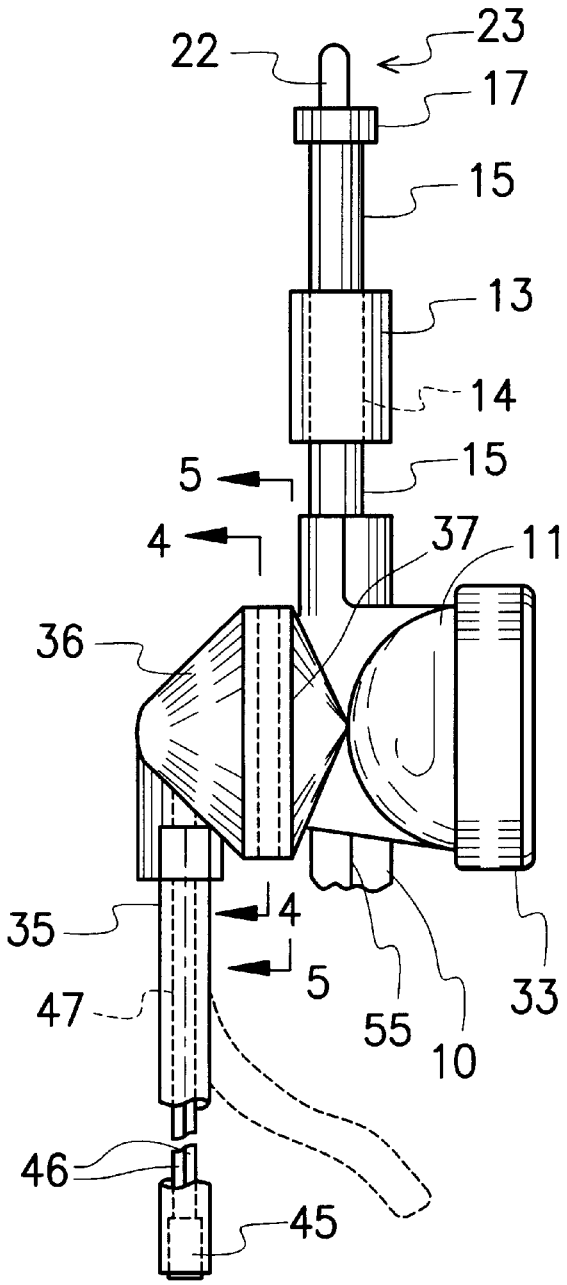
Figure 3:
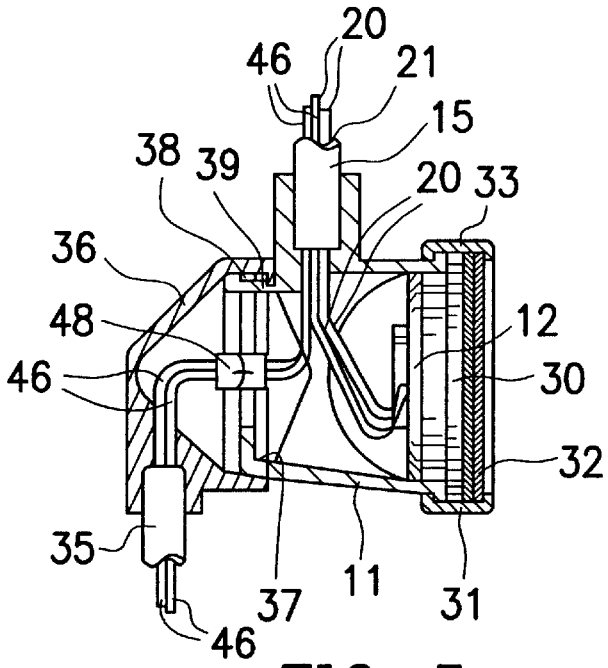
Figure 4:
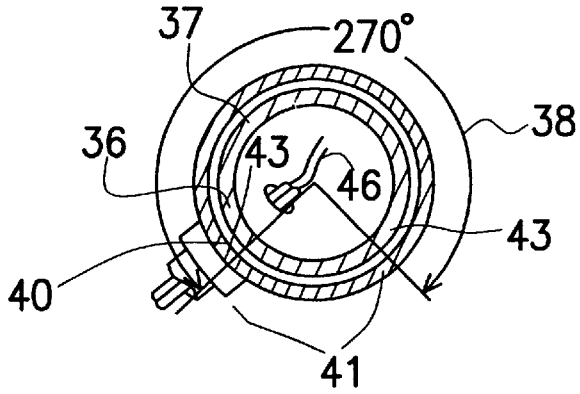
Figure 5:
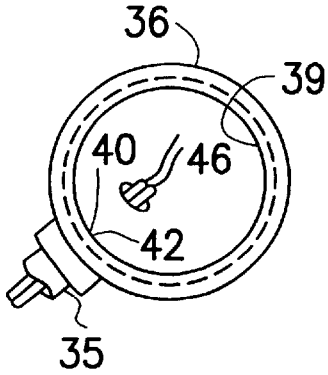
Figure 6:
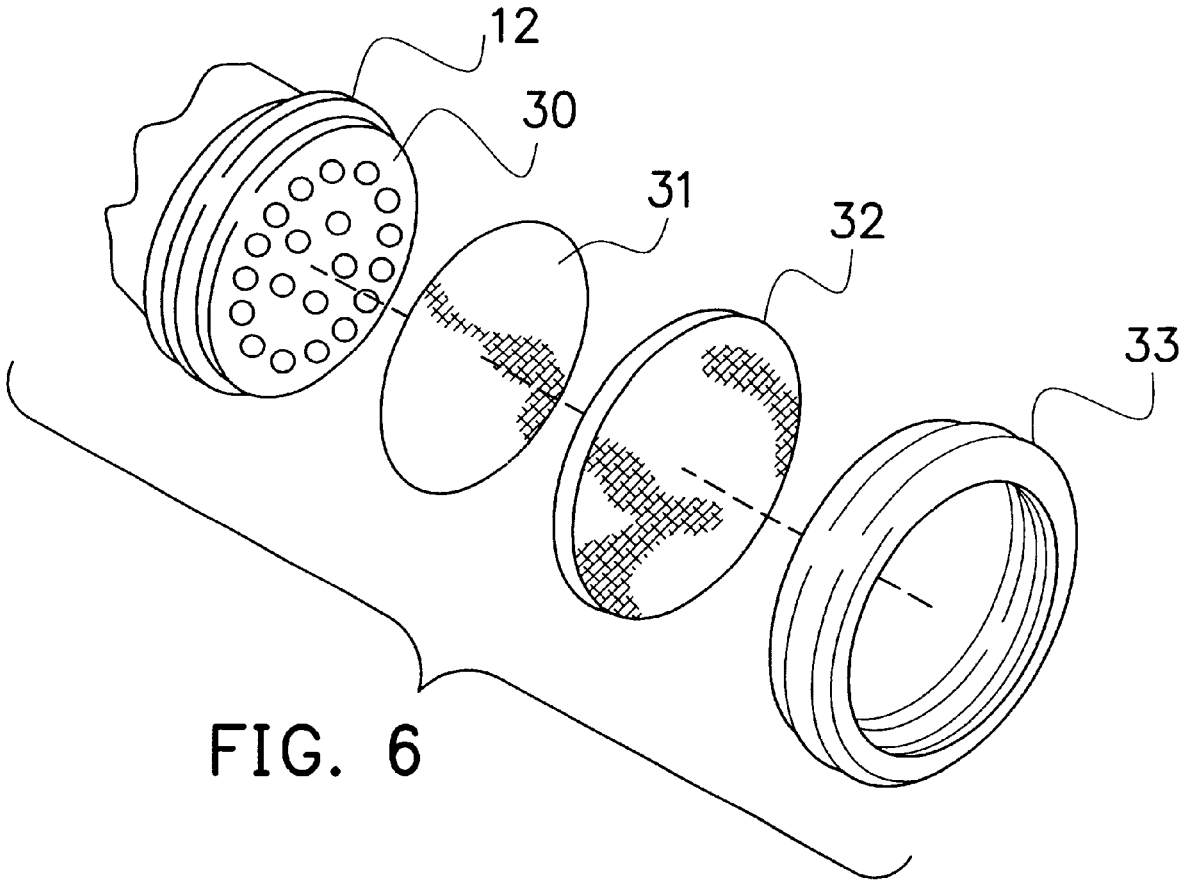
Figure 7:
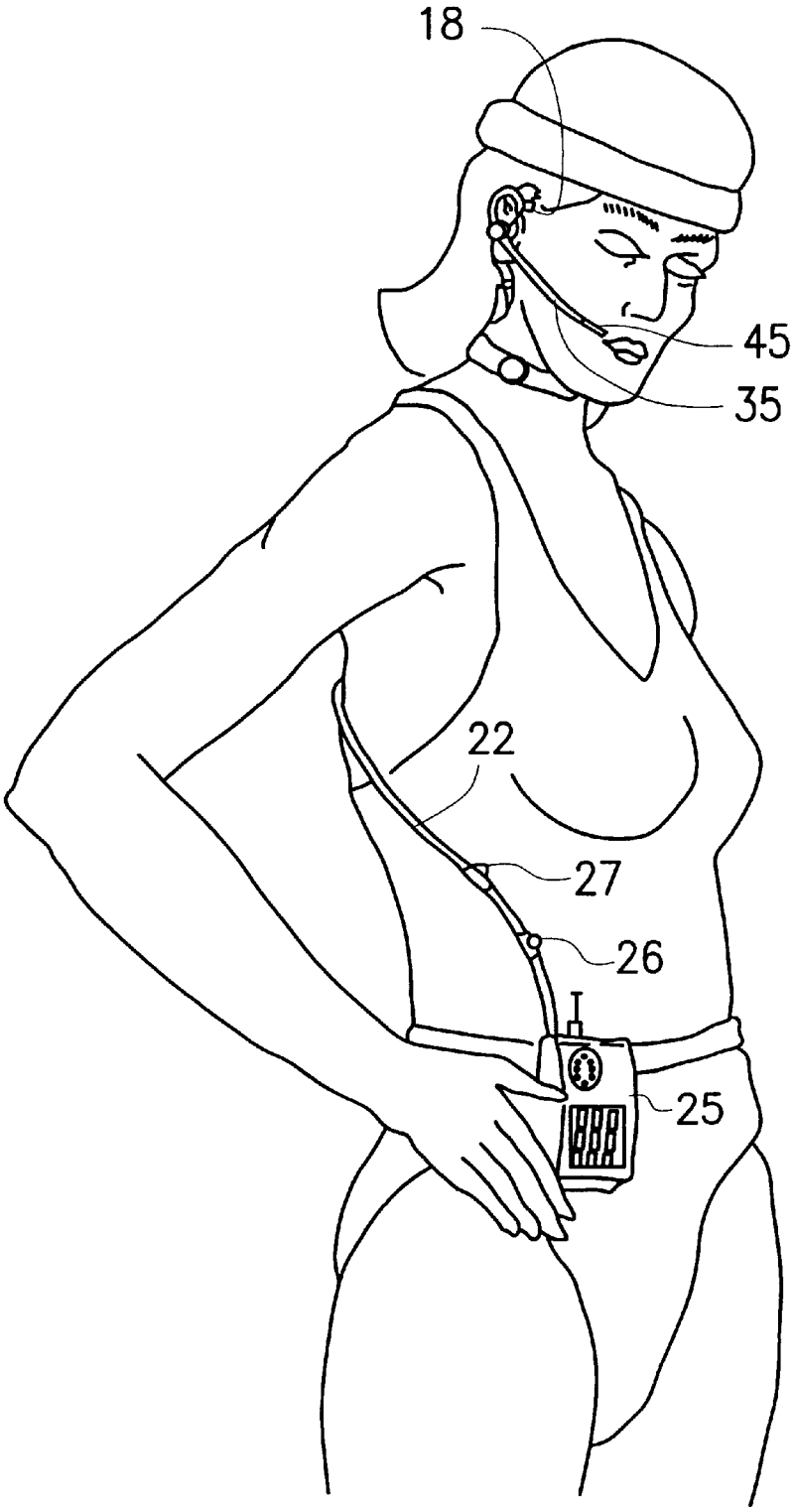
Figure 8:
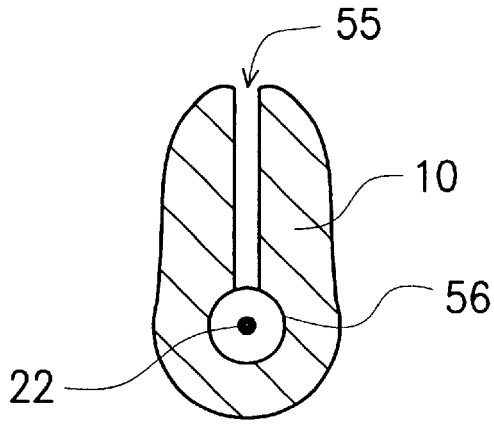
Figure 9:
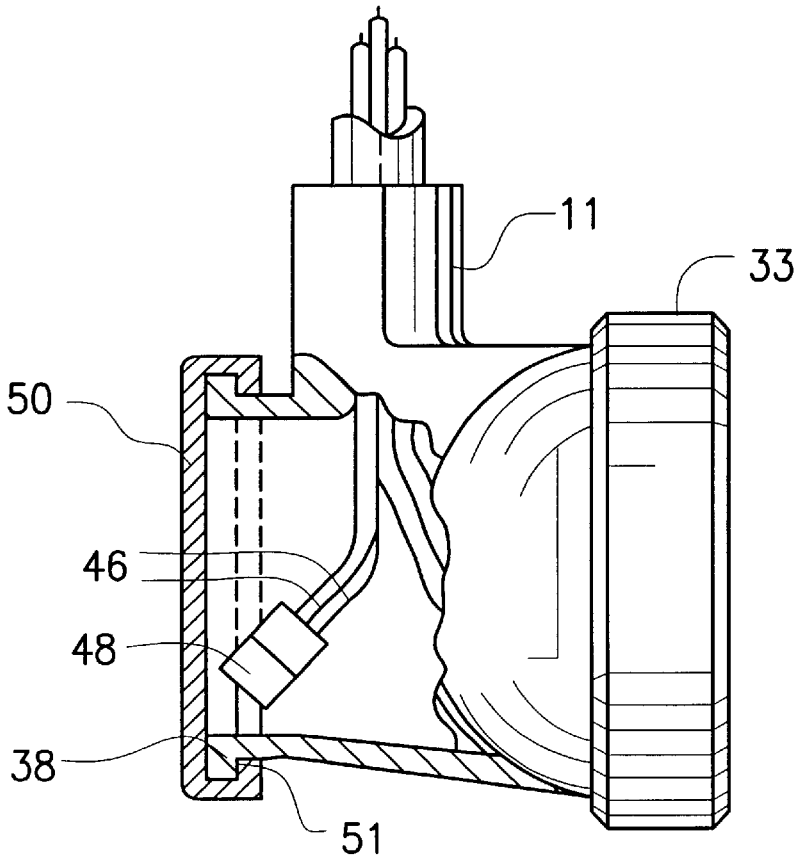

The best mode presently contemplated for carrying out the invention is illustrated in the accompanying drawings, in which:

FIG. 1 is a side elevation of an earphone of the invention with a microphone mounted thereon;

FIG. 2, a front elevation of the earphone of FIG. 1 taken from the left in FIG. 1;

FIG. 3, a fragmentary vertical section taken on the line 3—3 of FIG. 1 showing the speaker, speaker housing, and microphone arm mounting;

FIG. 4, a vertical section taken on the line 4—4 of FIG. 2;

FIG. 5, a side elevation of the microphone mounting taken on the line 5—5 of FIG. 2, but not showing the speaker housing;

FIG. 6, an exploded view showing the speaker and its mounting to the speaker housing;

FIG. 7, a perspective view of a communication system being worn by a user;

FIG. 8, a vertical section through the earpiece taken on the line 8—8 of FIG. 1; and FIG. 9, a fragmentary vertical section similar to that of FIG. 3, but showing the microphone mounting removed and a cap in its place.

DETAILED DESCRIPTION OF THE ILLUSTRATED EMBODIMENT

The current invention will be illustrated and described in connection with earphones as shown in my U.S. Pat. No. 5,412,736, and the disclosure of such patent is hereby incorporated by reference. While the current inventions were specifically developed to complement the earphones shown in my cited patent, they have application with other earphones as well.

As shown, particularly in FIG. 1, an earphone of the invention includes an earpiece 10 which serves as an ear mounting means designed to fit behind the ear of a user and to support a speaker housing 11. Speaker housing 11 includes a speaker 12, FIG. 3, mounted therein to be comfortably positioned at the entrance to the auditory canal of an ear of the user. A sleeve 13 is formed at the forward end of the earpiece 10 with an opening 14 therethrough sized to tightly receive a boom 15 extending from the speaker housing 11. The fit of boom 15 in sleeve opening 14 is such that a user can slide boom 15 longitudinally back and forth in sleeve 13 as indicated generally by arrow 16 and can rotate boom 15 in sleeve 13, but, when sliding or rotational force is not present, boom 15 will be frictionally held in place with respect to sleeve 13 and earpiece 10. In this manner, the position and orientation of speaker housing 11 can be adjusted with respect to earpiece 10 so that speaker housing 11 can be comfortably positioned at the entrance to the ear's auditory canal for just about any potential user of the earphones. A stop 17 on the end of boom 15 prevents the boom 15 from being removed from sleeve 13. The earpiece 10, which extends between the ear and the user's head with sleeve 13 at the forward end of earpiece 10 extending over the upper forward portion of the ear as shown at 18 in FIG. 7, in combination with speaker housing 11 which fits into the ear and boom 15 which adjustably connects the speaker housing 11 and earpiece 10, cooperate with the user's ear to comfortably position and hold the speaker 12 and the speaker housing 11 in the user's ear at the entrance of the auditory canal even during vigorous physical activity by the user.

A pair of wires 20 extend from speaker 12, FIG. 3, through a central bore 21 in boom 15. The wires extend from the end of boom 15 as a single, insulated multiconductor wire 22 to form a loop 23 before entering earpiece 10 where the wires extend inside earpiece 10 to its remote end 24 below the ear lobe of a user. The loop 23 provides slack in wire 22 to allow movement of boom 15 in sleeve 13. A length of the wire 22 extends from the earpiece remote end 23 for attachment at a remote location to a signal source. This could be a communication device such as a cellular telephone 25, FIG. 7, worn on the waist of the user, a personal audio system similarly worn by the user, or a combination communication device and personal audio system. The end of wire 22 away from the earphones will generally include a standard plug or jack for plugging into a socket in the telephone or audio system in standard manner. Where two earphones are used, wire 22 will include a Y-connector, not shown, but located behind the user's back in FIG. 7, so that wires extend to both earphones. If desired, wire 22 may also include a built in volume control 26 and built in manual communication switch 27 for manually switching a microphone on and off. Depending upon the communication system used, a Y-connector may also be provided at the end of the wire near the communication device to separate wires to the speaker or speakers from wires from the microphone. Each set of wires would have its own plug to be placed into the appropriate socket of the communication device.

Various speakers may be used in the earphones and mounted in speaker housing 11. Some high quality speakers 12 include a metal protective cover 30, FIG. 6. It has been found that use of the earphones during strenuous activity by the user can result in perspiration or other moisture reaching this metal cover and causing it to corrode. Therefore, it is an aspect of the invention to place a waterproof material such as a thin layer of latex 31 over the metal speaker cover 30 and sandwiching it between the usual corrosion resistant metal screen grill 32 with all parts held together by resilient ring 33. The latex could extend completely around the speaker 12, if desired. The flexible, thin latex membrane 31 will transmit sound with substantially negligible loss. Adhesive can be placed around the perimeter of the membrane 27 to increase the waterproofing properties thereof. If desired, sealing material, such as a silicone rubber, may be placed around the wires extending from the end of boom 15 and any other openings in speaker housing 11 may be sealed to substantially increase the water resistant properties of the speaker housing 11 around the speaker, although this is not necessary to prevent corrosion of the speaker cover 26.

If the earphones are to be used merely for listening, the speaker housing 11 will be closed behind the speaker as shown in my referenced patent.

It has been found that earphones are worn during the use of various communication systems, particularly where communication is necessary during activities which occupy the hands, such as in the operation of switchboards, or in noisy environments, such as in airplanes. There are other times where hands-free communication systems may be useful such as in law enforcement situations where a police officer, for example, may need to keep his or her hands free but would still like to be in constant communication with a remote location, such as police headquarters. Further, with the growth in use of cellular and similar telephones, people participating in activities such as jogging or driving may like to be able to communicate by such telephone in a hands-free manner during such activity. Comfortable earphones that securely mount on the ears, such as those described above, are a desirable feature of such a communication system. For two-way communication, however, a microphone is needed. For hands free communication, it is necessary that the microphone be held in operative position near a user's mouth. Generally, this will entail mounting the microphone on an earphone. It will generally be advantageous in a communication system to have two earphones, one for each ear, as it is with a personal audio system. However, in some instances a single earphone may be desirable, particularly where, in addition to the communication, a person has to be able to hear all surrounding sounds.

For use with a communication system, provision is made to have the single earphone when only one earphone is used, or one of the earphones when two earphones are used, include mounting means for a microphone. As shown, a microphone arm 35 extends from a microphone arm mounting base 36 adapted to be rotatably mounted on a receiving section 37 at the back of speaker housing 11. Receiving section 37 is circular with an outwardly extending flange 38 around its circular perimeter. The microphone arm mounting base 36 has a circular opening to fit over flange 38 of speaker housing receiving section 37, with inwardly extending lip 39 that snaps over flange 38 to secure the mounting base 36 to receiving section 37 in a manner that allows the mounting base to be rotated with respect to speaker housing 11. Stop 40 on microphone arm mounting base 36 adjacent lip 39 interacts with stops 41 on speaker housing receiving section 37 to limit rotation of the microphone arm mounting base 36 and microphone arm 35 extending therefrom to back and forth rotation of about 270 degrees with respect to the speaker housing 11. At one extreme of rotation, the microphone arm will be positioned as shown in FIGS. 4, 5, and 7 to extend from the earphone worn on the user's right ear. At the other extreme of rotation, the extremes of rotation being shown by arrow 38, FIG. 4, the microphone arm will extend similarly but from the earphone worn on the user's left ear and on the opposite side of the mouth as shown in FIG. 7. This rotatability allows a user to have the microphone arm extend from either the right or left earphone as desired or to change from one ear to the other. The rotatability of the speaker housing 11 through rotation of boom 15 in sleeve 13 allows the orientation of speaker housing 11 to be easily changed for wearing the same earphone on either the right or left ear. The stops are positioned so that at either extreme of rotation they will hold and prevent the microphone arm from rotating downwardly during vigorous activity by the user. In this regard, it should be noted that with the stop arrangement described and with the microphone arm mounting base 36 properly mounted on speaker housing 11, the microphone arm would never extend straight downwardly as shown in FIGS. 1, 2, and 3. This position is for illustration purposes only or with an arrangement of stops which would allow such downward positioning. If desired, stop 40 on microphone arm mounting base 36 may have an extended portion 42, FIG. 5, that is compressed and frictionally resists movement of the mounting base 36 between stops 41 and which expands into detentes 43, FIG. 4, when positioned against a stop 41 to substantially lock the base in rotated position. Various other arrangements of stops, detentes, etc. could be used.

A microphone 45, FIGS. 2 and 7 is positioned in the end of microphone arm 35. A pair of wires 46 extend from microphone 45 through a bore 47 in microphone arm 35, into microphone arm mounting base 36 and into speaker housing 11. In speaker housing 11, wires 46 join with wires 20 to become part of multiconductor wire 22 which extends to the communication device 25, FIG. 7, worn by the user. Signals from the microphone are transmitted to the communication device by wires 46 while signals from the communication device or audio system are transmitted to the speaker 12 by wires 20. For ease of assembly, or to make the microphone arm removable, a plug and socket assembly 48 for wires 46 may be provided in speaker housing 11.

Microphone arm 35 will generally be flexible but shape retaining so it can be bent by a user to a desired configuration as shown in FIG. 7 to position the microphone to pick up sounds from a user's mouth.

When a speaker housing is constructed for mounting a microphone thereto, if it is desired to not use the microphone, the earphone may be set up so that the microphone arm mounting base 36 is removable and can be snapped off speaker housing 11 and a small circular cover 50 with lip 51, FIG. 9, can be removably snapped in place instead of the microphone arm mounting base. The microphone wires 46 would be separated at plug and socket assembly 48 when the microphone assembly is removed and reconnected when the microphone assembly is again mounted on speaker housing 11.

It is desirable to have the wire 22 containing the wires to speakers 12 and wires to microphone 45 extend in and along earpiece 10 from the remote end 24 to a position near sleeve end 13. In my earphones as shown in my cited patent, the earpieces were molded in two halves, the wire placed along one half, and the second half glued to the first half with the wire between the halves. I have now found that the earpiece 10 can be molded as single integral parts with a slit 55, FIGS. 1, 2, and 9 extending into the earpiece along a portion of its length intermediate the ends thereof. The interior of the slit can be molded with a wire receiving recess 56, FIG. 8, therealong. Wire 22 can then be inserted through earpiece remote end 24 into slit 55 using a needle or similar item and similarly extended through earpiece 11 at the opposite end of slit 55 as at 57. The wire 22 will preferably be inserted in a manner so that it is tightly held by end 24, but loosely held by the passage through the opposite end. Wire 22 does not have to be in slit 50 during these operations and generally will not be. With the wire 22 extended through the opposite ends of the earpiece 10 (enough wire is inserted through the earpiece so that the wires extend to speaker 12 and microphone 35, if used), it is then pushed into slit 50. The wire can then be extended through boom 15 leaving loop 23 to allow slack for positional adjustment of speaker housing 11. The wire can also be inserted through earpiece 10 in the opposite direction to that indicated, the particular direction and order of insertion not being critical. Once in recess 56, wire 22 will remain within earpiece 10.

As indicated, the earphones of the invention can be used with various types of audio and communication systems which can be worn by a user such as in a manner shown by FIG. 7, or located separate from a user such as if used, for example, in an automobile or airplane. Various systems and arrangements can be used.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An ear mounted earphone for use by a user having an ear with an entrance to an auditory canal therein, comprising a speaker; a speaker housing mounting the speaker; an elongate boom extending from the speaker housing; ear mounting means having ends and a curved intermediate portion, the intermediate portion configured to fit behind the ear of a user between the user's head and ear with one end extending over an upper portion of the user's ear; sleeve means in the end of the ear mounting means extending over an upper portion of the user's ear for frictionally holding the boom therein and allowing forced sliding of the boom in the sleeve longitudinally to adjust positioning of the speaker housing with respect to the mounting means and forced rotation of the boom in the sleeve means to adjust orientation of the speaker housing with respect to the mounting means; a stop at the end remote from the housing to prevent the boom from sliding completely through the sleeve and separating from the ear mounting means, whereby the ear mounting means in combination with the speaker housing and boom will cooperate with a user's ear to position and hold the speaker at the entrance of the user's auditory canal; and wherein a wire extends from the ear mounting means, through the boom, and into the speaker housing to connect with the speaker.

2. An ear mounted earphone according to claim 1, additionally including a water-resistant material positioned over the speaker to resist moisture contacting the speaker.

3. An ear mounted earphone according to claim 2, wherein the water-resistant material is a layer of latex.

4. An ear mounted earphone according to claim 1, additionally including a microphone arm and means mounting the microphone arm to the speaker housing.

5. An ear mounted earphone according to claim 4, wherein the means mounting the microphone arm to the speaker housing includes a microphone arm mounting base from which the microphone arm extends, and a receiving section in the speaker housing for receiving in attaching relationship the microphone arm mounting base.

6. An ear mounted earphone according to claim 5, wherein the receiving section of the speaker housing includes a circular portion having a peripheral flange, and the microphone arm mounting base includes a circular opening into which the receiving section extends and includes a lip which interlocks with the flange to secure the base to the receiving section and allow relative rotation between the two.

7. An ear mounted earphone according to claim 6, additionally including cooperating stops on the receiving section and on the microphone arm mounting base to limit the amount of rotation of the mounting base with respect to the microphone housing, the amount of rotation allowed being sufficient to change the position of the microphone arm to properly position a microphone when the earphone is worn on either a right ear or left ear.

8. An ear mounted earphone according to claim 7, wherein the amount of rotation allowed is about 270°.

9. An ear mounted earphone according to claim 7, wherein the microphone arm mounting base is removably secured to the receiving section.

10. An ear mounted earphone according to claim 9, additionally including a cap which is removably secured to the receiving section when the microphone arm mounting base is removed from the receiving section.

11. An ear mounted earphone for use by a user having an ear with an entrance to an auditory canal therein, comprising a speaker; a speaker housing mounting the speaker; an elongate boom extending from the speaker housing; ear mounting means having ends and a curved intermediate portion, the intermediate portion configured to fit behind the ear of a user between the user's head and ear with one end extending over an upper portion of the user's ear; sleeve means in the end of the ear mounting means extending over an upper portion of the user's ear for frictionally holding the boom therein and allowing forced sliding of the boom in the sleeve longitudinally to adjust positioning of the speaker housing with respect to the mounting means and forced rotation of the boom in the sleeve means to adjust orientation of the speaker housing with respect to the mounting means, whereby the ear mounting means in combination with the speaker housing and boom will cooperate with a user's ear to position and hold the speaker at the entrance of the user's auditory canal; and wherein the ear mounting means has an elongate slit therealong intermediate the ends thereof, and wherein a wire extending from a signal source to the earphone extends in and along the slit.

12. An ear mounted earphone according to claim 11, wherein the slit has a bottom, and wherein the slit includes a wire receiving recess extending along the bottom of the slit.

13. An ear mounted earphone according to claim 12 wherein the wire extends through the ends of the ear mounting means.

* * * * *